US008201565B2

(12) United States Patent
Fernandez et al.

(10) Patent No.: US 8,201,565 B2
(45) Date of Patent: Jun. 19, 2012

(54) NAIL GROOMER

(75) Inventors: Juan Fernandez, Towaco, NJ (US); Paul McGrath, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 156 days.

(21) Appl. No.: 12/725,645

(22) Filed: Mar. 17, 2010

(65) Prior Publication Data

US 2010/0236565 A1 Sep. 23, 2010

Related U.S. Application Data

(60) Provisional application No. 61/210,630, filed on Mar. 20, 2009.

(51) Int. Cl.
*A45D 29/05* (2006.01)
*A45D 29/04* (2006.01)
*A45D 29/20* (2006.01)

(52) U.S. Cl. ..... 132/73.6; 132/75.6; 132/75

(58) Field of Classification Search ..... 132/73.6, 132/73, 73.5, 75, 75.3, 75.4, 75.6, 75.8, 76.2, 132/76.4, 76.5, 294, 300, 309, 314, 315, 132/317; 119/610, 608, 609, 614, 620, 633; 451/358, 79, 177; 206/820, 821, 822, 581, 206/38, 528; 220/501, 503, 697, 812
See application file for complete search history.

(56) References Cited

U.S. PATENT DOCUMENTS 1,047,889 A 12/1912 Gooch
1,231,327 A 6/1917 Brauchler
1,503,378 A * 7/1924 Reid ..... 132/296
1,683,851 A * 9/1928 Wells ..... 206/236
1,742,862 A 1/1930 Jones
1,831,327 A 11/1931 Surdock
1,892,867 A 1/1933 Burr
2,239,870 A 4/1941 Val Ariza
2,504,795 A 4/1950 Biasi
2,880,737 A 4/1959 Tone et al.
2,935,972 A 5/1960 Hard
3,126,021 A 3/1964 May
3,916,921 A 11/1975 Pesola
4,137,926 A 2/1979 Pao
4,408,623 A 10/1983 Murray
4,683,897 A 8/1987 McBride
4,944,402 A * 7/1990 Wu ..... 206/581

(Continued)

FOREIGN PATENT DOCUMENTS

CA 2036312 8/1992

(Continued)

*Primary Examiner* — Todd Manahan
*Assistant Examiner* — Vanitha Elgart
(74) *Attorney, Agent, or Firm* — Gearhart Law, LLC

(57) ABSTRACT

The invention is a hand held nail and foot groomer for people, which includes a spherical nail groomer body having at least one compartment for batteries and tips; a semi-spherical tip cover assembly having an opening, being in substantial contact to the nail groomer body and being movably connected to the nail groomer body; a combination battery, motor and tip compartment; a tip assembly for attachment of various shapes and sizes of nail files and brushes. The preferred embodiment of this invention is one in which the nail body optionally includes a flat bottom section which includes one or more detachable ringed or recessed sections, said ring sections or recessed sections capable of holding rounded and optionally recessed files and/or pumice stones and/emery files and/or foot scarpers useful in grooming feet.

12 Claims, 7 Drawing Sheets

U.S. PATENT DOCUMENTS

| | | | | |
|---|---|---|---|---|
| 5,025,817 | A * | 6/1991 | Wen | 132/296 |
| 5,123,430 | A * | 6/1992 | Davidovitz | 132/75.8 |
| 5,226,541 | A * | 7/1993 | Huang | 206/581 |
| 5,280,679 | A | 1/1994 | Edelman | |
| 5,287,979 | A * | 2/1994 | Bourgeois | 220/4.21 |
| 5,465,740 | A * | 11/1995 | Kim | 132/73.6 |
| 5,620,455 | A | 4/1997 | Grigoletto | |
| 5,732,719 | A | 3/1998 | Godbout | |
| 5,762,077 | A * | 6/1998 | Griffiths, Jr. | 132/74.5 |
| 5,842,483 | A | 12/1998 | Timko | |
| 5,946,823 | A | 9/1999 | Yates | |
| 6,070,749 | A * | 6/2000 | Joulia | 220/4.22 |
| 6,102,209 | A * | 8/2000 | D'Andrea | 206/581 |
| 6,162,117 | A * | 12/2000 | Vo | 451/358 |
| 6,540,083 | B2 * | 4/2003 | Shih | 206/581 |
| 6,588,435 | B1 * | 7/2003 | Gindi | 132/293 |
| 6,640,811 | B2 * | 11/2003 | Cho | 132/73.6 |
| 6,647,988 | B2 | 11/2003 | Christianson | |
| 6,656,484 | B1 | 12/2003 | Lube | |
| 6,832,688 | B1 | 12/2004 | Rivera et al. | |
| 6,886,695 | B1 * | 5/2005 | Karoly | 206/581 |
| 7,021,318 | B2 * | 4/2006 | Byun | 132/294 |
| 7,100,620 | B2 * | 9/2006 | Fung | 132/73.5 |
| 7,267,125 | B2 * | 9/2007 | Nevakshonoff | 132/73.6 |
| 7,428,881 | B2 | 9/2008 | Drelinger | |
| 7,740,370 | B2 * | 6/2010 | Campbell et al. | 362/135 |
| 2003/0006236 | A1 | 1/2003 | Ross | |
| 2005/0056295 | A1 * | 3/2005 | Lam | 132/73.5 |
| 2005/0081759 | A1 | 4/2005 | Snead | |
| 2006/0137703 | A1 * | 6/2006 | Kling | 132/73.6 |
| 2006/0191553 | A1 | 8/2006 | Anderson et al. | |
| 2006/0260629 | A1 * | 11/2006 | Chern | 132/73.6 |
| 2007/0028936 | A1 | 2/2007 | Kriser | |
| 2007/0131240 | A1 * | 6/2007 | Prague | 132/294 |
| 2007/0221238 | A1 * | 9/2007 | Tran | 132/73.6 |
| 2008/0166261 | A1 | 7/2008 | O'Keefe | |
| 2008/0264438 | A1 * | 10/2008 | Clelland | 132/76.4 |
| 2009/0022562 | A1 | 1/2009 | Chin | |
| 2009/0126750 | A1 | 5/2009 | Pellereau | |
| 2009/0260653 | A1 * | 10/2009 | Ramos | 132/294 |
| 2009/0301507 | A1 * | 12/2009 | Tes et al. | 132/73.6 |
| 2010/0083975 | A1 * | 4/2010 | Nguyen et al. | 132/200 |

FOREIGN PATENT DOCUMENTS

| | | | |
|---|---|---|---|
| CA | 2142949 | | 7/1996 |
| CA | 2475301 | | 8/2003 |
| CN | 101048089 | | 10/2007 |
| DE | 20 2005 010 136 | U1 | 9/2005 |
| FR | 2 661 330 | A1 | 10/1991 |
| FR | 2 859 078 | A1 | 3/2005 |
| GB | 2420974 | | 6/2006 |
| HU | 0800056 | | 9/2009 |
| JP | 01135709 | A | 5/1989 |
| JP | 10203929 | A | 8/1998 |
| JP | 2000212043 | A | 8/2000 |
| JP | 2003079422 | A | 3/2003 |
| JP | 2005035937 | A | 2/2005 |
| WO | WO 03 070049 | A1 | 8/2003 |
| WO | WO 2006 006036 | A2 | 1/2006 |
| WO | WO 2006 046011 | A2 | 5/2006 |
| WO | WO 2006 046011 | A3 | 5/2006 |
| WO | WO 2007 038847 | A1 | 4/2007 |
| WO | WO 2009 021299 | A1 | 2/2009 |

* cited by examiner

NAIL GROOMER

CLAIM OF PRIORITY

This application claims prior of a U.S. Patent No. 61/210,630 filed on Mar. 20, 2009, the contents of which are fully incorporated herein by reference.

FIELD OF THE INVENTION

The present invention relates to devices for human nail and foot care, in particular to hand held nail groomers.

BACKGROUND OF THE INVENTION

Portable hand held devices for grooming hands and feet are well known in the art.

Both men and women cannot maintain clean and neat nails and groomed feet with the busy schedules and require a quick and simple way to maintain nail and foot hygiene. They are particularly useful for trimming and smoothing nails when away from home or when one does not have the time and/or the money to visit a nail salon. Furthermore, they have the added convenience of working with a motorized device and do not require excess manual labor.

Several manicuring devices for fingernail grooming are known. Fingernail grooming includes trimming, shaping, filing, cuticle removing, cuticle pushing, polishing, buffing and cleaning. These devices usually include a separate casing enclosing a motor for operating a detachable grooming accessory. An alternate approach is one which stores the casing holding the motor inside a larger casing holding the bits. Consequently, the casing of this invention is of a size not easily carried in a ladies' purse or bag especially when one already carries in it cosmetics, a telephone, a wallet, a palm, a brush and others. One device can store bits, but does not have a small design and is not a hand and foot hygiene device.

There is a need for an inexpensive, compact and portable nail and foot groomer that can fit in the palm of the hand while also having storage for the attachments.

SUMMARY OF THE INVENTION

The invention is a hand held nail and foot groomer for people, which includes a spherical nail groomer body having at least one compartment for batteries and tips; a semi-spherical tip cover assembly having an opening, being in substantial contact to the nail groomer body and being movably connected to the nail groomer body; a combination battery, motor and tip compartment; a tip assembly for attachment of various shapes and sizes of nail files and brushes.

The preferred embodiment of this invention is one in which the nail body optionally includes a flat bottom section which includes one or more detachable ringed or recessed sections, said ring sections or recessed sections capable of holding rounded and optionally recessed files and/or pumice stones and/emery files and/or foot scarpers useful in grooming feet.

Therefore, the present invention succeeds in conferring the following, and other not mentioned, desirable and useful benefits and objectives.

It is an object of the present invention to provide a portable hand-held nail grooming device.

It is another object of the present invention to provide a detachable single or double-sided bottom section which contains a combination of foot scraper, emery file or pumice stone.

Yet another object of the present invention is to provide a separate handle for attaching to a foot scraper, or to an emery file, or to a pumice stone.

Still another object of the present invention is to provide a nail and body grooming device that includes a plurality of attachments that may be connected to a rotating electrical motor, for a fast and painless grooming procedure.

Still another object of the present invention is to provide a cap that provides a flat bottom surface to conceal the detachable rings and to enable to rest the present invention in an upright manner.

Yet another object of the present invention is to provide a device that may be able to be powered by DC or AC currents.

Still another object of the present invention is to provide device that is capable of storing multiple grooming attachments inside an internal storage compartment.

DESCRIPTION OF THE PREFERRED EMBODIMENTS

Figure 1A:
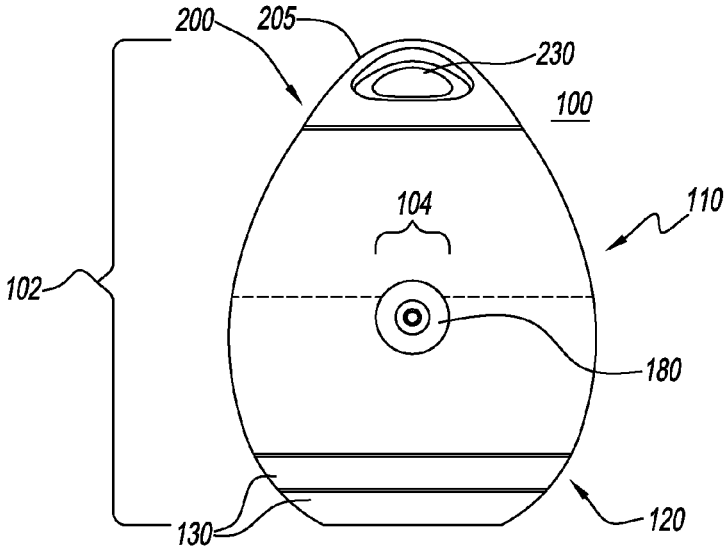
FIG. 1A is a side view of the preferred embodiment of the present invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1A. is a side view of the preferred embodiment of the present invention. Shown are a nail groomer 100, a nail groomer body 110, a bottom detachable section 120, detachable rings 130, a power switch 180, a tip assembly 200, a tip assembly door 205, and finger indentations 230. The nail groomer 100 may preferably have a spherical shape or any other shape and at least one tip assembly 200 that is moveably connected to the groomer body 110. The tip assembly 200 may be twisted onto the nail groomer body 110 or be snapped on. The exterior of the tip assembly 200 contains a tip assembly door 205, and finger indentations 230, which are useful in achieving a good grip to untwist or pry open the tip assembly 200. For example, a user of the present invention, may be in the midst of applying makeup, crèmes, or may simply be in a hurry, and will therefore not be able to exert a strong enough grip on the cover 205. Using the finger indentations 230, or perhaps in another embodiment, using frictional bumps or other frictional elements avoids having to use an especially tight grip on the tip assembly 200, in order to open the tip assembly door 205, so as to reveal the tip 190 (FIG. 5B), which is part of the present invention that directly acts on nails or skin.

The nail groomer 100 has a tip assembly 200 that closes, or a tip assembly 200 that may be partially open to accommodate a nail, for example. This tip assembly 200 may be moveably connected to the nail groomer body 110 by a hinge (not shown), or may be a screw-type device (not shown). When closed, the groomer tip assembly 200 can protect the attached accessory 210 (FIG. 5*b*), which is a general name for an individual tip 190. The tip assembly 200 may have several sections, one section that covers the tip 190 on one side and partially reveals it on the other. For safety, a door may 205 may slide sideways over the tip assembly section 200 that partially uncovers the attached accessory 210. The finger indentations 230 may still be present, however they may be biased towards the direction of the twisting motions of the tip assembly door 205. The tip assembly 200 may also hold scrapings from the nails or feet, for easy disposal of the nail pieces and scrapings. In another embodiment, the present invention may contain an intake valve that may be connected to a miniature vacuum. The miniature vacuum would cause enough suction to pull in and store the majority of the nail shavings, so that the physical area where a person was utilizing the present invention remains clean and free of unappetizing debris.

The nail groomer 100 optionally contains a suction cup to provide for hands-free usage. The suction cup may be attached to the nail groomer in numerous ways. For example, it may be built-in directly to the nail groomer, it may snap on and off or it may twist on and off.

In another embodiment, the nail groomer fits 100 ergonomically in the human hand. This ergonomic shape may be made of rubber, foam, neoprene and may be smooth or may have raised bumps or a by kind of texture. The material may also assist in preventing slippage of the nail groomer from the hand, especially when hands are wet. Other ergonomic features may be specially applied designs or frictional grips The nail groomer 100, its body 110, detachable rings 130 and accessories 210 may be made of may be made from any material, including but not limited to: plastics and resins including but not limited to plastic, rubber, foam, silicone, ABS, Polycarbonate, Noryl™, PVC, Polystryrene, ABS/PVC, PVC/Acrylic, Polysulfone, Acrylic, Polyethylene, Kydex™, PETG; glass, including but not limited to fiberglass, borosilicate, or quartz; wood; metals, including but not limited to iron, tin, aluminum, copper; rubber including but not limited to natural rubber, SBR, Isoprene rubber, Butadiene rubber, and Chloroprene rubber; or any combinations or composites of these materials or other materials and new materials that may be manufactured in the future. The parts to the nail groomer 100 may be manufactured using identical or different materials.

The nail groomer 200 should preferably be between 2 and 4 inches high 102 and between 1.4 and 3 inches wide 104. In the preferred embodiment of the nail groomer body 110 being substantially elliptical, the width 104 is referring to the diameter of the thickest point of the elliptical body 110. The power switch 180 may preferably be located along the body 110, where it can easily be activated by one of the fingers of a hand that is holding the device. However it can be located in any other location and may be a toggle switch, a depressible switch, or a shifting switch, or any other power switch 180.

Figure 3A:
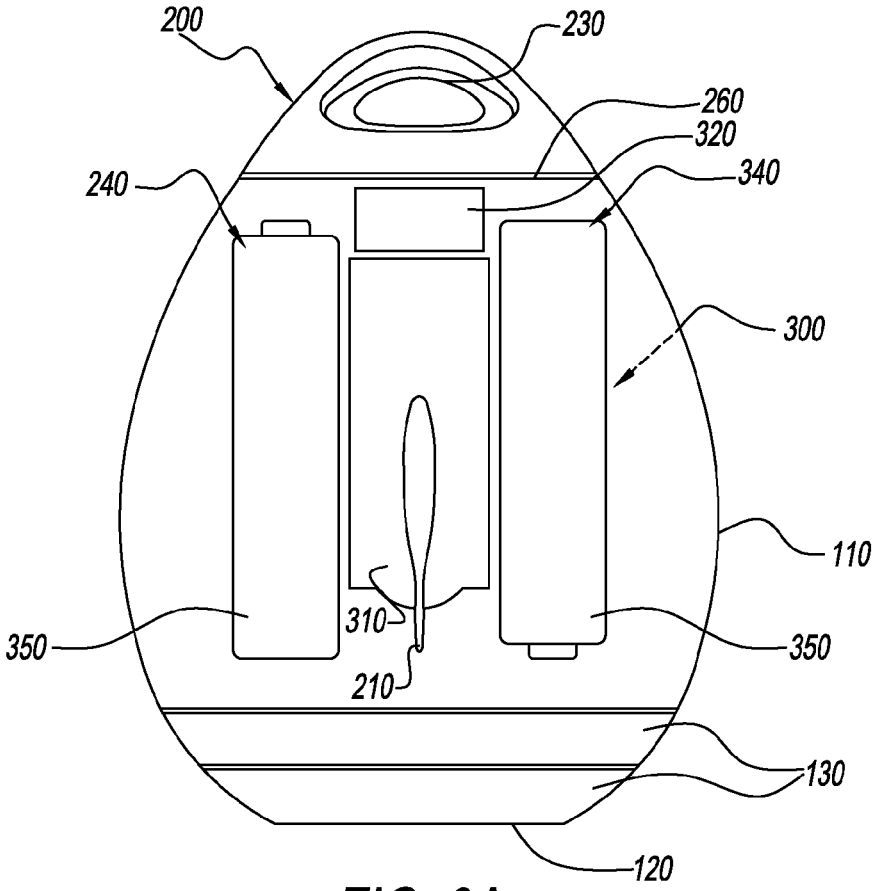
FIG. 3A is a transparent side view of the preferred embodiment of the present invention.

Power switches 180 are generally simple devices and are well known in the art. A toggle switch is one where, for example, a button is pressed and released to complete a circuit and enable the flow of electrons. Pressing and releasing the power switch 180 again will disable the device since the internal flow of electricity would be disrupted. A depressible switch is one which needs to be pressed and which stays depressed while the device is active, and a shifting switch is one where an arrow or a pointer shifts sideways, or up and down into an ON position or an OFF position. Any of these power switches 180 may be utilized with the present invention. In another embodiment, the present invention may contain a variable switch or a power variation switch, which may regulate the rotational speed of the motor 320 (FIG. 3A).

A bottom detachable section 120 may be substantially flat so that the device is able to stand upright. Alternatively a separate stand may be provided. The detachable rings 130 may be replaced or augmented by a separate chamber door (not shown), which may open to reveal a battery compartment 240 or a storage compartment 310 (FIG. 3A).

Figure 1B:
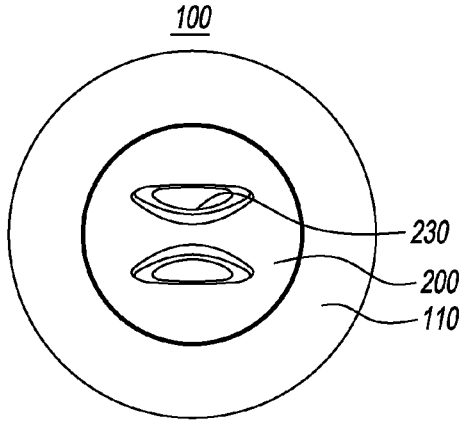
FIG. 1B is a top view of the preferred embodiment of the present invention.
Figure 1C:
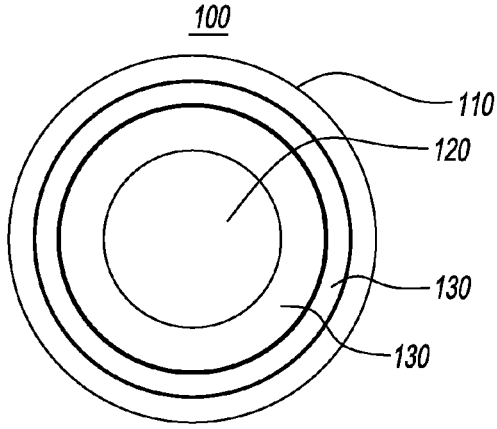
FIG. 1C is a bottom view of the preferred embodiment of the present invention.

FIG. 1B and FIG. 1C provide an alternative viewing angle of the present invention. FIG. 1B shows a tip assembly 200, finger indentations 230 and a nail groomer body 110. FIG. 1C shows the bottom detachable section 120, which is composed of to detachable rings 130. Also shown is the nail groomer body 110. It should be noted that the bottom detachable section 120 need not be detachable, rather the battery compartment 340 may be accessed by disassembling the device in along the middle of the nail groomer body 110 or by removing the tip assembly 200.

Figure 2:
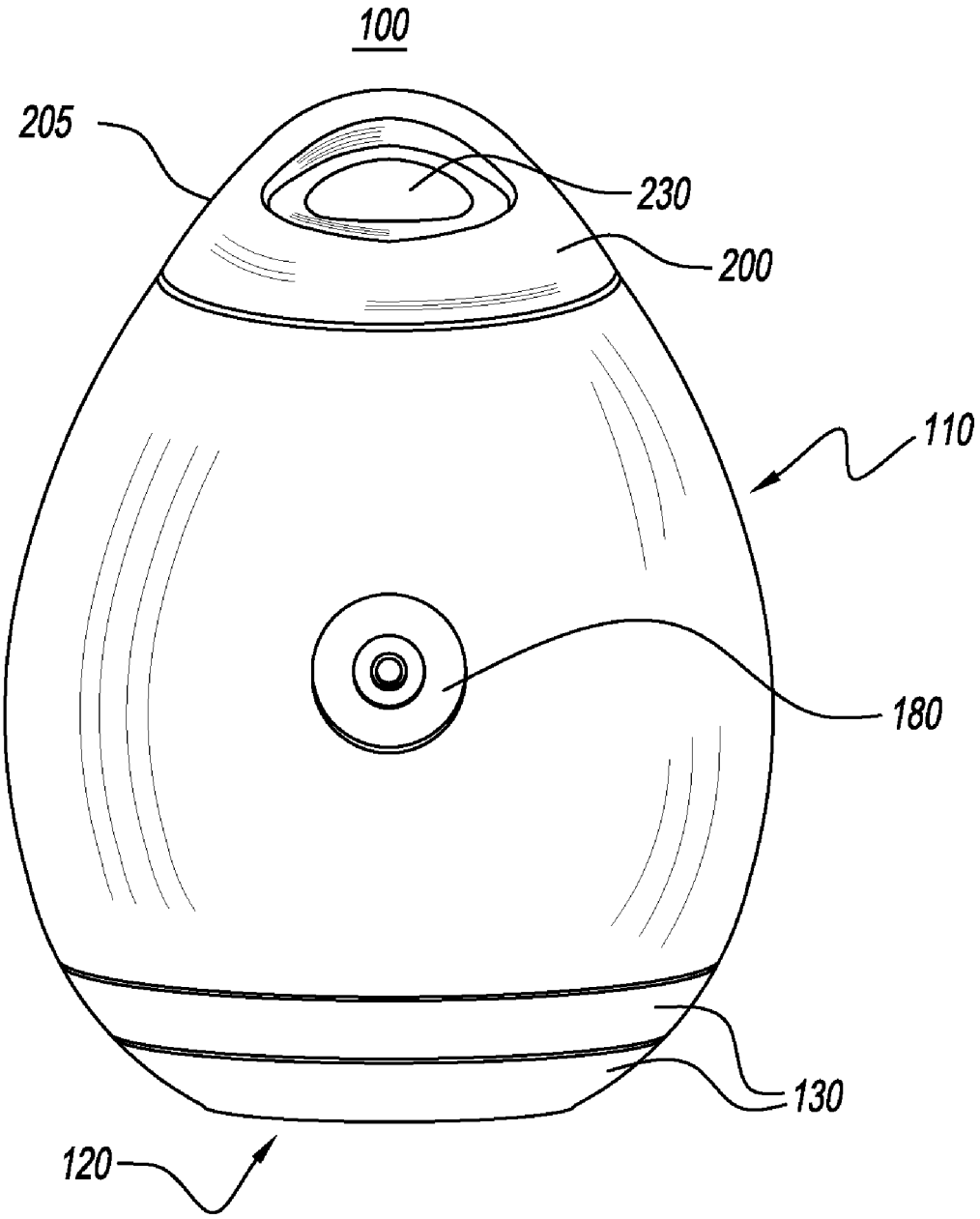
FIG. 2 is a side view of the preferred embodiment of the present invention.

FIG. 2 is a side view of the nail groomer 100 Shown are a nail groomer 100, a nail groomer body 110, a bottom detachable section 120, detachable rings 130, a power switch 180, a tip assembly 200, a tip assembly door 205, and finger indentations 230.

Figure 5A:
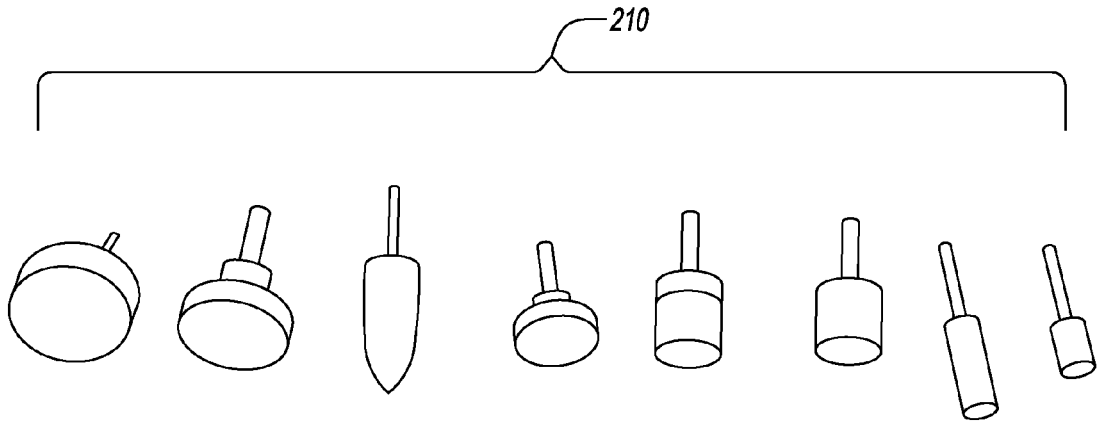
FIG. 5A is a view of the various accessories that may be utilized with the present invention.

FIG. 3A is a transparent side view of the present invention. Shown are a nail groomer 100, a nail groomer body 110, a bottom detachable section 120, detachable rings 130, a power switch 180, a tip 190, a tip assembly 200, a tip assembly door 205, an accessory 210, finger indentations 230, a tip assembly base 260, a groomer chamber 300, a storage compartment 310, a motor 320, a battery compartment 340, and batteries 350. The present invention provides a storage compartment 310 having a section for batteries 340, a motor 320 and accessories 210. Due to the compact size of the nail groomer body 110, the groomer chamber 300 preferably contains combination of a battery compartment 340, place for a motor 320 and the accessory storage compartment 310, all in a close proximity to each other. The accessory storage compartment 310 may store one or more of the attachments 210 (FIG. 5A). The motor 320 may be battery operated or may be powered by an A/C adaptor (not shown), which can be used to directly power the motor, recharge batteries or a combination thereof. An electric motor 320 is well known in the art and may preferably be a miniature electric motor.

Figure 3B:
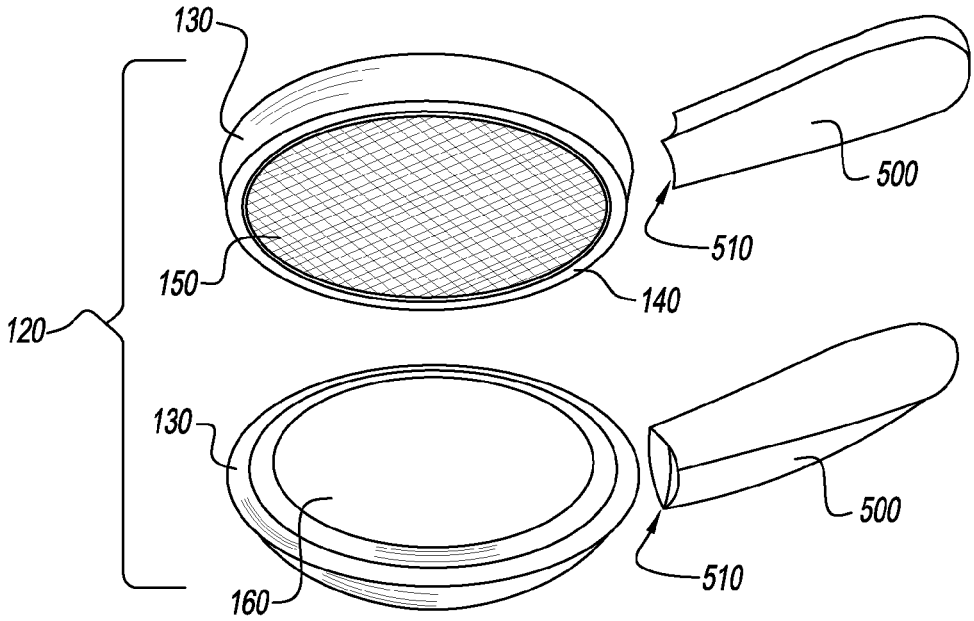
FIG. 3B is an exploded view of the preferred embodiment of detachable rings, also showing a holder handle.

A preferred class of motors 320 may be, but not limited to a brushless or coreless DC motor, for a purely battery powered embodiment, or for an embodiment where an A/C adaptor only functions as a charger for the batteries 350; a universal motor may be used for embodiments of the invention that are utilizing either A/C current or a DC current. It is desirable that the motor may produce between 10000 and 35000 revolutions per minute (RPM), so that the device is both effective and efficient. The power may come from A/C adaptor, which may function at 220 V or 110 V. In a battery power embodiment, the preferred combination are any combinations of two to three AA batteries producing 1.5 V each. For smaller embodiments of the present invention, AAA batteries may be used, taking into account that such miniaturization may lead to shorter operating time of the device between charging or battery replacements. A single PP3 battery may be used if a higher voltage is desired or necessary. Other combinations or power sources may also be adapted for use in the present invention The storage compartment 310 may preferably be moveably connected to the inside of the nail groomer chamber 300 by a spring-loaded device (spring not shown). In such an embodiment, a spring will be fully or substantially depressed and under maximum lateral tension when the storage compartment 310 is completely submerged within the nail groomer chamber 300. A latch not shown may hold the storage compartment 310 in place while fully submerged. Alternatively, the storage compartment may be prevented from emerging by the bottom detachable section 120. In another embodiment, the storage compartment 310 may slide out by force of gravity or by being pulled out with fingers. In such an embodiment the storage compartment 310 may move along small rails (not shown) built into the groomer chamber 300. The storage compartment 310 may be located behind a door (not shown) which may be a separate component or may be one of the detachable rings 130 (FIG. 3B). Any item functioning as a door that conceals the nail groomer chamber 300, should preferably be located at the bottom of the nail groomer body 110. The storage compartment 310 is made to hold one or more, batteries 350, a motor 320 and one or more accessories or tips 210.

FIG. 3B is a detailed drawing of the bottom detachable section 120, which may be made up of one or more detachable rings 130. Shown in this figure are detachable bottom section 120, detachable rings 130, a detachable recessed attachment metal file for foot 150, a detachable recessed attachment pumice stone 160, a holder handle 500, and handle connector 510. The handle 500 should be preferably between two and 4 inches long and contain a connector 510, which is preferably a spring loaded clamp which clasps onto a side 140 of the detachable ring 130. The handle 500 may be composed of telescoping sections, so that it may be able to be folded and stored within the storage compartment 310.

Each detachable ring 130 may fixate unto the nail groomer body 110 or to another ring 130 in a twist on or snap-on connection. A twist on connection would mean that the devices contain a twist-on thread, whereas a snap on connection would mean that one component may have a tongue portion of the snap, while the other a latch portion of the snap. However, the tongue and latch may be intermixed as well. The detachable rings 130 are capable of turning into foot grooming devices by having abrasive surfaces, such as, but not limited to emery files, metal file scrapers and pumice stones. A detachable ring 130 may be dual-sided with one side having a metal scraper or file 150 with the other being a pumice stone 160. Any other combination is also possible, for example one both sides representing metal files 150 or pumice stones 160 of different grades.

If the bottom most detachable ring 130 is dual-sided then the present invention may additionally contain a flat convex of concave cap bottom 540 (FIG. 6), so that a person handling the nail groomer 100 will not come to inadvertently get injured or incur any property damage, by inadvertently handling an abrasive side of the a detachable ring 130. Such a cap may fit over the rings 130 and conceal them, or attach to the bottom of the bottom most ring 130. The detachable rings 130 or the handle 500 may attach to each other and the detachable ring 130 to the nail groomer body 110 by means already disclosed, or by any means known to those skilled in the art. The detachable rings 130 may be recessed in shape to accept one of the above metal files, emery files, pumice stones and foot scrapers.

Figure 4:
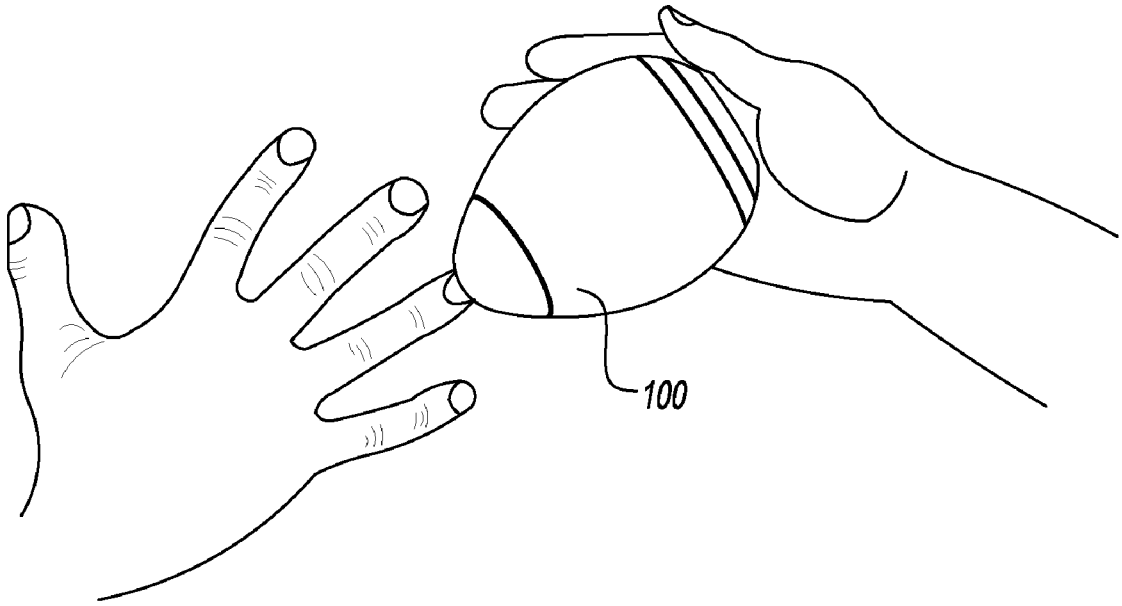
FIG. 4 is a view of a use of the preferred embodiment of the present invention.

FIG. 4 shows one application of the nail groomer 100, with the device being held in one hand while a nail of the other hand is being worked on. Similarly, the nail groomer 100 may be held in one's hand to treat the nails of the feet. An application of a metal scraper 150 or a pumice stone 160 is not shown, but may be easily conjured as a series of methodical lateral motions that scrape off any undesirable callus layer of the skin.

FIG. 5A shows an array of attachments 210 or tips 190. An attachment contains a tip 190 together with a tip assembly 220. The tip connector 220 may be a rod, preferably made of metal, but may be made from a polymer, plastic, PVC or a composite material. However, in some embodiments the tips 190 may represent the detachable section of accessories 210, where the tip connector 220 may represent an integral portion of the motor 320.

Figure 5B:
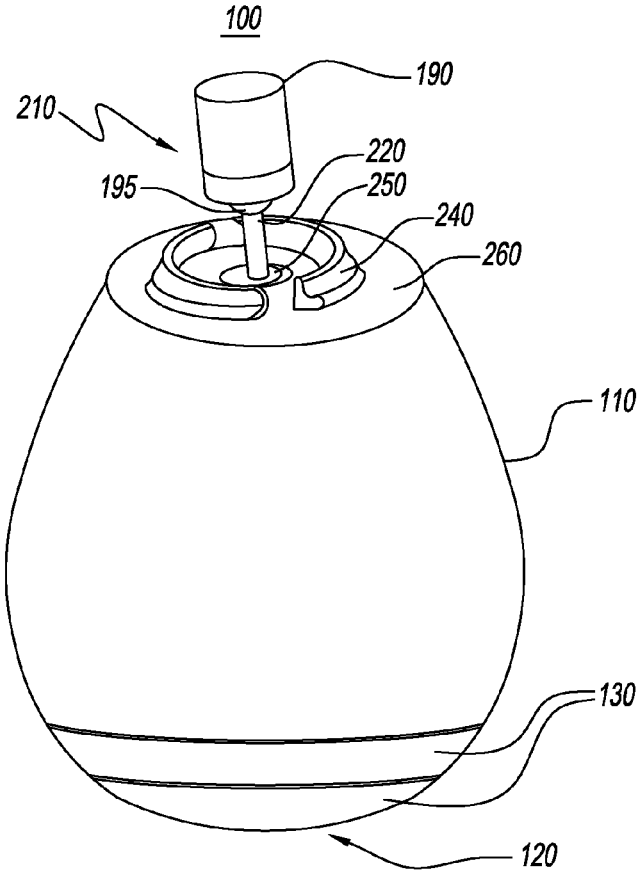
FIG. 5B is a perspective side view of the present invention, with the tip assembly door removed to reveal an installed and ready to use tip.

The present invention may be marketed or adapted to utilize multiple attachments 210. Some of the attachments include, but are not limited to a hand held nail filer, nail buffer, cleaning brush, metal file, one or more cone-shaped nail files, flat head nail files, rounded nail files and files of differing grinding grades, and any other accessories for grooming hands and feet. Attachments 210 may be built directly into the nail groomer body 110 or intimately attached such as with a tip clamp 250 (FIG. 5B). The attachments 210 may be on a hinge, or may snap in and out, or may screw in or out, or any combination thereof. Another attachment 210 may be used for the removal of hair. A further attachment 210 may be an orbital shaped foot sander. In another embodiment, attachments 210 may be made of materials which are embedded with crystals which may be used to smooth surfaces. The crystals may be made of any material known to those in the art. Furthermore the attachments may be of many sizes and shapes to accommodate their intended purpose and to accommodate the site of the body part being treated or groomed. To fit within the tip assembly 200, an attachment 210 should preferably be no longer than a half an inch in length. However, without a tip assembly door 205 being in place the attachment 210 may be of any length necessary to treat or groom a particular condition.

FIG. 5B is a perspective drawing of the preferred embodiment of the present invention with the tip 190 exposed and the tip assembly door 205 removed. The door assembly 205 may also be moved out of the way by being disposed on a hinge (not shown) or on a set of rails (not shown). One plus of such an embodiment, is that the tip assembly door 205 may not get lost during the operation of the present invention. Also shown in this fig. are a nail groomer 100, a nail groomer body 110, a bottom detachable section 120, detachable rings 130, a tip 190, a tip assembly 200, an accessory 210, a tip connector 220, tip assembly rails 240, a clamping part 250, and a tip assembly base 260. The tip assembly base 260 supports the tip assembly door 205. The tip assembly rails 240 accept and securely hold a tip assembly door 205 with either a snap on tension connectors or by having a thread, so that the tip assembly door 205 may be snapped on or off, or twisted on or off, to cover or to reveal the tip 190. The tip connector 220 may be an integral part of the accessory 210 or may be permanently attached to the motor 320. If an integral part of the accessory 210, the tip connector may be held in place at the clamping part 250 with a set of spring loaded jaws or a threaded opening, or a frictional opening. The tip may be movably connected to the nail groomer body 110, meaning it is able to rotate with the help of the motor 320. The tip assembly rails 240 may be raised to terminate over or at the same level as the tip 190. In such an embodiment nail and skin shavings generated by the tip 190 may be captured by the assembly rails 240. Alternatively, a screen may be mounted over the tip 190, with only a part of the tip 190 exposed for nail or skin treatment. In another alternative, a compact vacuum may be disposed inside the groomer chamber 300 with an suction aperture located at the assembly base 260.

It may be preferable to have the tip 190 be separate from the tip connector 220, so that more tips 190 may be able to fit within the internal storage compartment 310. In such an embodiment the clamping part 250 may be disposed on the bottom of the tip 195, and may be a set of spring loaded jaws, or a threaded or frictional opening.

The present device may be operated by opening the detachable bottom section 120 and extracting the internal storage compartment 310. Once the internal storage compartment 310 is extracted, the device may be primed for use by properly loading the correct number and type of batteries 350 into the nail groomer battery compartment 340. While the internal storage compartment 310 is open, the tips 190 are contained within it, therefore a user shall extract one of the tips 190 and mount it within the tip assembly 200. The user may then depress the internal storage compartment 310 back into the nail groomer chamber 300 and close the door or reattach the bottom detachable section 120, which may also be able to slide or swing away on rails of its own (not shown). As the last step, the person shall depress the power switch 180 and begin grooming in a desired fashion. Alternatively, a user may simply remove one of the detachable rings 130, attach a handle 500 thereon and then proceed with the grooming process.

Figure 6:
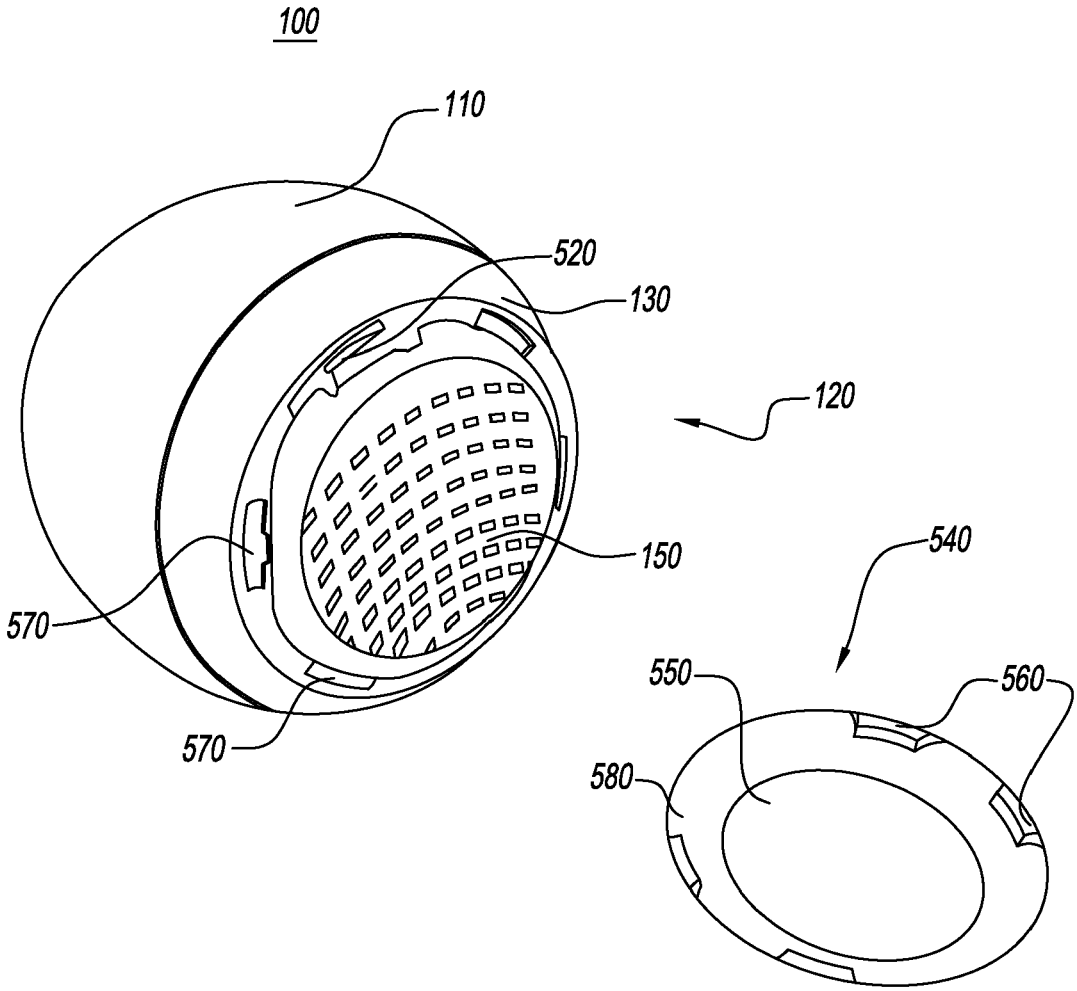
FIG. 6 is another embodiment of the present invention embodiment of the present.

FIG. 6 shows the bottom-focused perspective view of another embodiment of the present invention. Shown are a nail groomer 100, a nail groomer body 110, a bottom detachable section 120, a detachable ring 130, a file 150, file mating sockets 520, a bottom cap 540, an inner surface of the cap 550, cap mating tabs 560, cap mating sockets 570, and a tapered sidewall 580. In this embodiment, the file 150, which may also be a scraper, a foot scraper, or an emery file, is provisionally mounted within file mating sockets 520, and conceals a recessed area for capturing and collecting nail or skin shavings (not shown). Periodically, the file 150 may be removed from the file mating sockets 520 to clean out the recessed area. Alternatively the file 150 may be mounted using a threaded or a snap mating mechanism.

The bottom cap 540 fits over the file 150, to conceal it. The bottom cap 540 is preferably held to the bottom detachable section 120 with cap mating tabs 560 that snap into the cap mating sockets 570. Alternatively, any means of affixation may be used, such as, but not limited to a threaded mating, a rail and groove combination, or a snap tab and groove combination. The inner surface 550 is preferably flat to allow the nail groomer 100 to stand upright when the bottom cap 540 is in place. The inner surface 550 is raised over the file 150 by the tapered sidewall 580, giving the bottom cap 540 a conical, elliptical appearance that preferably includes a flat bottom that may preferably function as a stand.

Still referring to FIG. 6, the ring 130 may be detached from the groomer body 110. Detaching the ring 130, would reveal the groomer chamber 300, and may also revieal a pumice stone 160 (see FIG. 3B), which in this embodiment is preferably located on the reverse side of the recessed area for collecting file shavings. Alternatively the file 150 may contain a pumice stone 160 on its reverse side. In this alternative, one wishing to use the pumice stone 160, would detach the file 150 and reattach it with the reverse side facing outward, thus revealing the pumice stone 160. The ring 130 may be detached from the holder body 110 and affixed to a handle 500. Alternatively, the file 150 or the pumice stone may be used while the ring 130 is still attached to the holder body 110, upon removing the bottom cap 540.

Figure 7:
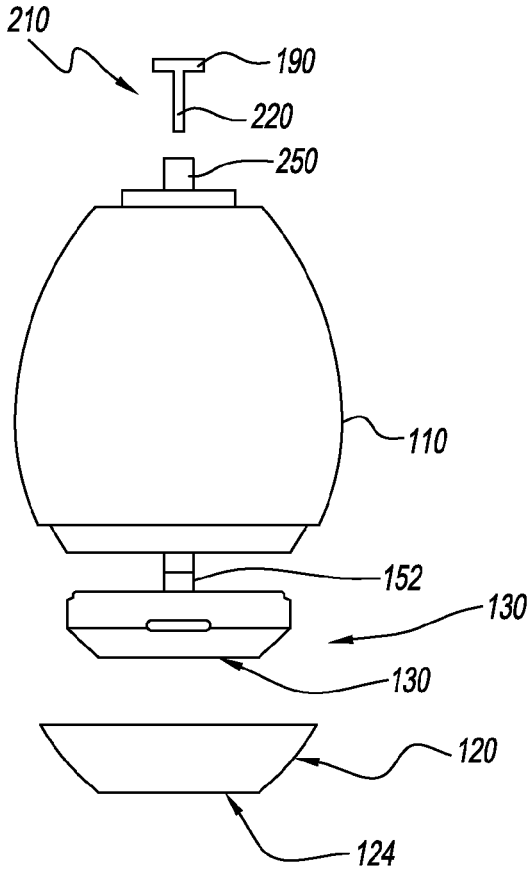
FIG. 7 is an exploded view of another preferred embodiment of the present invention, with both the top and bottom accessories being attached to a motor.

FIG. 7 shows another preferred embodiment of the present invention. Shown is an exploded side view of an embodiment where a motor within the nail groomer's body 110 is capable of rotating the attachment 210 and the detachable ring 130. A single motor may handle both tasks, or an additional motor may be provided. The metal scraper 150 is shown as a detachable section having a connector 152 that connects to the motor. The bottom detachable section 120 covers the metal scraper 150 when this accessory is not in use. The bottom detachable section 120 may also have an opening in the bottom facet 124, which exposes the scraping elements 154. Such an opening may contain a separate cover. The metal scraper 150 may first need to be lowered through this opening as part of the activation step. Although a metal scraper 150 is shown, a pumice stone or an emery file may be similarly implemented. The metal scraper 150 may a removable accessory that can be replaced with an accessory having an emery file or a pumice stone. In another alternative, the detachable ring 130 shown in FIG. 6 may be double sided, with one side having a metal scraper 150 and the other side having an emery file or a pumice stone.

Figure 7A:
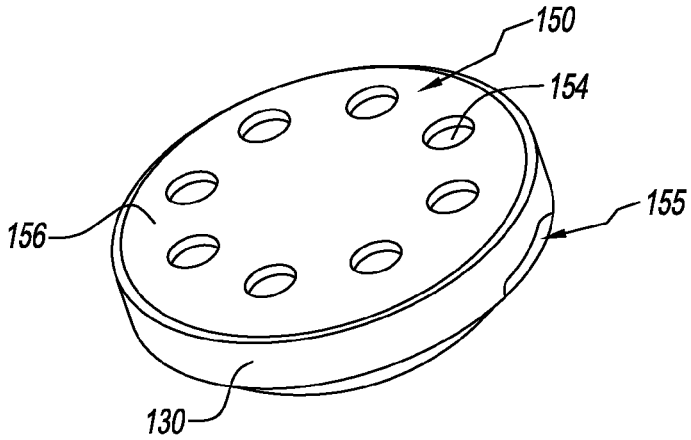
FIG. 7A is a detailed view of the rotating foot scraper.

FIG. 7A shows a detailed view of the metal scraper 150. The scraping elements 154 may be configured in a circle or cover the entire face 156. The ring 130 may be used to internally retain skin shavings generated during usage of the scraper 150. In such an embodiment the face 156 may be removable for cleaning. Also shown is a tab location 155, which may be used to secure the ring 130 within the body 110. The face 156 may rotate within the housing created by the ring 130, or the ring 130 may rotate a single unit. The power switch 180 may have a separate setting to engage the metal scraper 150 or the accessory 210, or there may be a separate power switch for the metal scraper 150.

The metal scraper 150 shown in FIG. 6 can be connected at the bottom section 120 or within the top clamping part 250. In either location, the metal scraper 150, as well as a pumice stone, a file, or a grater attachments are rotated by an internal motor.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A nail groomer, comprising:

a nail groomer body having a substantially spherical shape with parallel truncations with an opening at both a first and a second end;

at least one tip assembly, the tip assembly being moveably connected to the groomer body at one of the truncated ends;

a tip connector, housed within said tip assembly and connected to and rotationally driven by an electric motor;

a storage compartment movably connected to the interior of the groomer body, the storage compartment having sections for batteries, for said electric motor and for accessories;

said electric motor being operable on a voltage of 3 volts or less and rotating said tip connector at a rotational speed of 10,000 rpm or more; and a bottom detachable section, comprising a first and a second detachable ring, said first ring being removeably connected to the groomer body at an end opposite to the tip assembly, and said second ring being removably connected to said first ring, and wherein one of said rings comprises a substantially flat, circular metal file spanning the interior of the ring, and one of said rings comprises a substantially flat, circular pumice stone spanning the interior of the ring, and wherein the rings further serve to seal the opening of said groomer body at the end opposite said tip assembly and to hold in place the contents of the groomer body.

2. The nail groomer of claim 1, wherein the tip assembly is closed.

3. The nail groomer, of claim 1, wherein the tip assembly is at least partially opened.

4. The nail groomer of claim 1, wherein said storage compartment is located behind said detachable rings.

5. The nail groomer of claim 1, wherein said storage compartment contains one or more elements selected from: batteries, a motor, nail groomer accessories.

6. The nail groomer of claim 1, wherein the tip connector is capable of receiving one or more types of nail groomer accessories.

7. The nail groomer of claim 6, wherein said nail groomer accessories are selected from a cone shaped nail file, a flat head nail file, a rounded nail file, a buffer tool, a cleaning brush, a foot sander and a hair remover.

8. The nail groomer of claim 7, wherein said nail groomer accessories comprise a file having portions made of various grinding grades.

9. The nail groomer of claim 1, wherein said rings are removed and reattached by a screw-like action.

10. The nail groomer of claim 1, wherein said rings are removed and reattached by a snap-on-like action.

11. The nail groomer of claim 1, wherein said nail groomer is capable of capturing nail or skin shavings.

12. The nail groomer of claim 1, wherein said body has a power switch which activates the nail groomer motor.

* * * * *